US010682538B2

(12) United States Patent
Blondeau et al.

(10) Patent No.: US 10,682,538 B2
(45) Date of Patent: Jun. 16, 2020

(54) ROPING HARNESS

(71) Applicant: ZEDEL, Crolles (FR)

(72) Inventors: Loic Blondeau, La Tronche (FR); Pierre Plaze, Cruet (FR)

(73) Assignee: ZEDEL, Crolles (FR)

( * ) Notice: Subject to any disclaimer, the term of this patent is extended or adjusted under 35 U.S.C. 154(b) by 0 days.

(21) Appl. No.: 16/019,053

(22) Filed: Jun. 26, 2018

(65) Prior Publication Data

US 2018/0369621 A1 Dec. 27, 2018

(30) Foreign Application Priority Data

Jun. 26, 2017 (FR) ..... 17 55850

(51) Int. Cl.
*A62B 35/00* (2006.01)
*A63B 29/02* (2006.01)

(52) U.S. Cl.
CPC ..... *A62B 35/0025* (2013.01); *A62B 35/0012* (2013.01); *A62B 35/0031* (2013.01); *A63B 29/02* (2013.01); *A63B 2225/09* (2013.01)

(58) Field of Classification Search
CPC ..... A62B 35/0031; A62B 35/0012; A62B 35/0025; A63B 69/0048
See application file for complete search history.

(56) References Cited

U.S. PATENT DOCUMENTS 2,562,355 A * 7/1951 Grant ..... A61F 5/24 128/99.1
4,384,372 A * 5/1983 Rector ..... A41F 9/002 2/300
4,782,535 A * 11/1988 Yewer, Jr. ..... A45C 13/30 2/321
5,010,850 A * 4/1991 Sailer ..... A01K 27/00 182/3

(Continued)

FOREIGN PATENT DOCUMENTS

EP 1516646 A1 * 3/2005 ..... A62B 35/0012
EP 2404643 A1 * 1/2012 ..... A62B 35/0025

(Continued)

OTHER PUBLICATIONS

Feb. 16, 2018 Search Report issued in French Patent Application No. 1755850.

*Primary Examiner* — Katherine W Mitchell
*Assistant Examiner* — Candace L Bradford
(74) *Attorney, Agent, or Firm* — Oliff PLC

(57) ABSTRACT

The roping harness comprises:
a belt provided with a first strap and with at least first and second comfort parts arranged between the first strap and the user,
a pair of thigh straps,
a connecting element connected to the pair of thigh straps,
a first adjustment device configured to adjust the length of the first strap and to define the circumference of the belt.

(Continued)

The first comfort pad and second comfort pad are fitted movable in translation with respect to one another. The first comfort pad is fitted movable in translation with respect to the first strap along the first strap. The belt comprises at least a first blocking stop configured to prevent movement of the first comfort pad with respect to the second comfort pad beyond a threshold value, the first adjustment device forming a second blocking stop of the first comfort pad.

14 Claims, 4 Drawing Sheets

(56) References Cited

U.S. PATENT DOCUMENTS 5,421,809 A * 6/1995 Rise ..... A61F 5/028 128/876
5,586,969 A * 12/1996 Yewer, Jr. ..... A61F 5/028 128/101.1
5,671,699 A * 9/1997 Forbes ..... A61F 5/026 119/857
5,690,609 A * 11/1997 Heinze ..... A61F 5/028 128/115.1
6,099,490 A * 8/2000 Turtzo ..... A61F 5/028 2/311
D434,544 S * 12/2000 Goldman ..... D2/627
D437,901 S * 2/2001 Forman ..... D21/662
2007/0209869 A1* 9/2007 Martin ..... A45F 3/12 182/6
2019/0105521 A1* 4/2019 Roger ..... A62B 35/0031

FOREIGN PATENT DOCUMENTS

FR 3007994 A1 * 1/2015 ..... A62B 35/0025
FR 3007994 A1 1/2015
FR 3037811 A1 * 12/2016 ..... A62B 35/0006
WO WO-9942063 A1 * 8/1999 ..... A62B 35/0025
WO WO-0228482 A1 * 4/2002 ..... A62B 35/0025

* cited by examiner

ROPING HARNESS

BACKGROUND OF THE INVENTION

The invention relates to an adjustable roping harness, in particular a roping harness that is able to be quickly and easily adjusted for use in collective associations.

STATE OF THE ART

In the scope of occasional use for sport activities, and in particular in collective associations, roping harnesses are not used in repetitive manner by only one user. A harness is used by several different users who can present different builds. This configuration can be found in operation of an adventure park, a via ferrata or in an enterprise which supervises groups performing rock climbing on their vacation site. In conventional manner, a set of harnesses is used and is selected as best as possible in order to be able to equip visiting users presenting different builds.

It is particularly complicated to manage a set of non-adjustable harnesses as this means having to be able to provide a large quantity of harnesses in all available sizes to be able to meet the requirements of the different groups. The same is true for very slightly adjustable harnesses which are configured to be very slightly adjusted to a category of users who all present substantially the same build.

Roping harnesses intended for collective organisations and configured to be able to fit people having different builds therefore exist on the market. In order to reduce these stock management limitations, harnesses intended for collective organisations are configured to fit people having different builds in particular as far as pelvis size is concerned. A limited set of harnesses can therefore be adjusted more easily to suit groups of users of different builds.

The Béal company markets a harness under the name of Aero Team IV. The harness has a back foam pad and a strap which form the belt of the harness. The belt operates in conjunction with an adjustment device which is configured to adjust the circumference of the belt by adjusting the length of the strap.

This configuration proves not to be optimal as the harness is designed to be adjusted from XS size to XL size, i.e. for a pelvis with a circumference comprised between 60 cm and 100 cm. Consequently, when the user has a pelvis size of about 60 cm, a length of strap equal to at least 40 cm is left dangling from the belt.

When the user has a pelvis with a circumference of about 100 cm, there is no excess strap, but it can be observed that almost all of the belt is formed by the strap. The lumbar foam pad presents a limited surface so that if the user remains suspended in his harness for a long time, he will suffer a certain discomfort in the whole of the pelvic region.

OBJECT OF THE INVENTION

One object of the invention is to remedy these shortcomings by proposing an adjustable roping harness providing an improved comfort over with the whole range of use and which remains easy to adjust.

For this purpose, the harness comprises:

- a belt equipped with a first strap and with at least first and second comfort pads arranged between the first strap and the user,
- a pair of leg loops mechanically connected to the belt,

- at least a first adjustment device configured to adjust the length of the first strap and to define the circumference of the belt.

The harness is remarkable in that:

- the first comfort pad and second comfort pad are fitted movable with respect to one another,
- the first comfort pad is fitted movable in translation with respect to the first strap along the first strap and
- the belt comprises at least a first blocking stop configured to prevent movement of the first comfort pad with respect to the second comfort pad beyond a threshold value.

In one development, the first comfort pad always overlaps the second comfort pad.

In a preferential embodiment, the first comfort pad and second comfort pad are fitted movable with respect to the first strap.

Advantageously, the harness comprises the first comfort pad, the second comfort pad and a third comfort pad. The second comfort pad separates the first comfort pad and the third comfort pad. The first comfort pad and the third comfort pad are fitted in movable manner with respect to the second comfort pad.

In a particular embodiment, the second comfort pad is fixed to the first strap by a fixing part, the third comfort pad being separated from the first comfort pad by the fixing part. The third comfort pad partially covers the second comfort pad.

It is advantageous to provide for the harness to comprise a second blocking stop configured to prevent movement of the third comfort pad with respect to the second comfort pad beyond a threshold value.

In preferential manner, the harness comprises a second adjustment device forming an additional blocking stop.

It is also possible to provide for the first adjustment device to be fixed to a connecting element mechanically connecting the belt to the pair of thigh straps.

In another embodiment, the first comfort pad comprises a first slot for passage of the first strap defined by means of a first edge and the second comfort pad comprises a second slot for passage of the first strap defined by means of a second edge, the first slot and second slot being configured to form the first blocking stop preventing the first edge from passing through the second slot and/or the second edge from passing through the first slot.

In another development, the harness enables the comfort of the adjustable thigh straps to be enhanced.

For this purpose, the harness comprises:

- a belt,
- a pair of thigh straps, each thigh strap being provided with a first strap and with at least first and second foam pads arranged between the first strap and the user, the pair of thigh straps being mechanically connected to the belt,
- a first adjustment device configured to adjust the length of the first strap and to define the circumference of at least one thigh strap.

The harness is remarkable in that:

- the first comfort pad and second comfort pad are fitted movable with respect to one another,
- the first comfort pad is fitted movable in translation with respect to the first strap along the first strap and
- one of the thigh straps comprises at least a first blocking stop configured to prevent movement of the first comfort pad with respect to the second comfort pad beyond a threshold value, the first adjustment device forming a second blocking stop of the first comfort pad.

BRIEF DESCRIPTION OF THE DRAWINGS

Other advantages and features will become more clearly apparent from the following description of particular embodiments of the invention given for non-restrictive example purposes only and represented in the appended drawings, in which.

DETAILED DESCRIPTION

Figure 1:
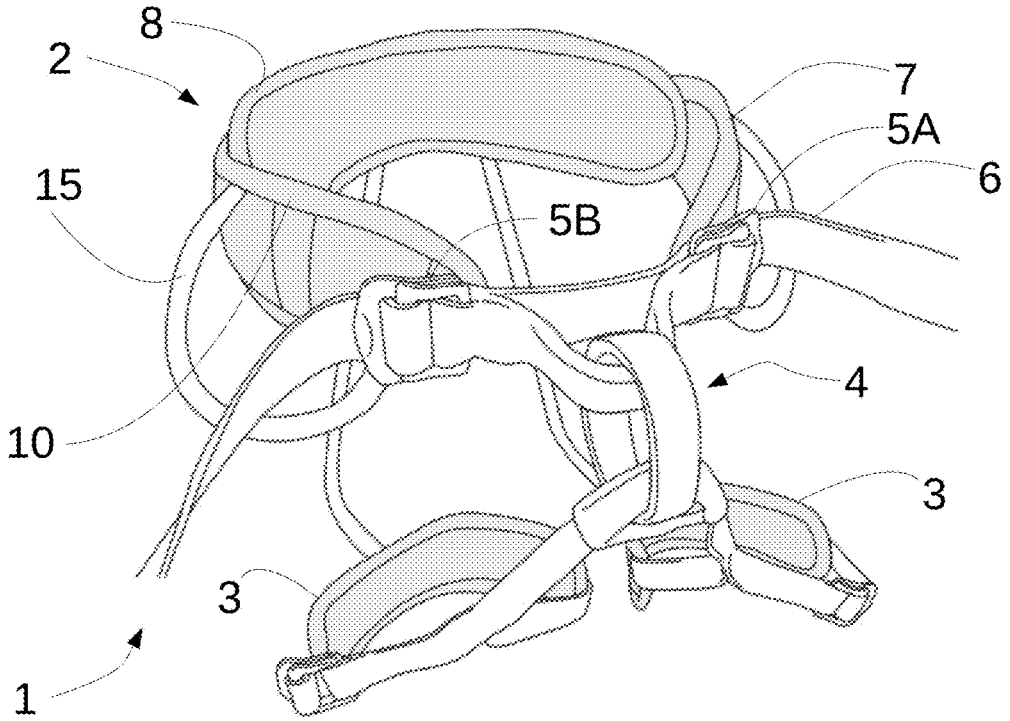
FIGS. 1 and 2 illustrate, in schematic manner, a first embodiment of a roping harness in two distinct configurations with different belt circumferences.

FIGS. 1, 2, 3, 4, 5 and 6 represent different embodiments of an adjustable harness, for example a climbing harness.

Harness 1 comprises a belt 2, a pair of thigh straps 3, and a connecting element 4 which closes belt 2 such as a belay loop or a tie-in loop. Connecting element 4 is mechanically connected to the pair of thigh straps 3. As an alternative, the pair of thigh straps 3 can be fixed directly to belt 2.

Harness 1 also comprises a first adjustment device 5A which is configured to adjust the circumference of belt 2 to the size of the user's pelvis.

Belt 2 is provided with a first strap 6 and with at least first and second foam pads 7 and 8 which are arranged between first strap 6 and the user. Foam pads 7 and 8 are arranged between first strap 6 and the user in order to form comfort areas which prevent direct contact between strap 6 and the user which may result in discomfort points.

First foam pad 7 and second foam pad 8 are fitted movable in translation with respect to one another along the longitudinal axis of first strap 6. First foam pad 7 partially covers second foam pad 8. Foam pads 7 and 8 are fitted movable with respect to one another so that the overlap ratio of first foam pad 7 by second foam pad 8 is modified according to the relative positions of the foam pads to one another.

First foam pad 7 is fitted movable in translation with respect to strap 6 along the longitudinal axis of strap 6. First foam pad 7 can therefore move along the circumference of belt 2 so as to adjust to the user's build and thereby cover first strap 2 as far as possible in order to prevent direct contact between first strap 2 and the user. In advantageous manner, at least 75% of the length of first strap 6 is covered by comfort foam pads. The length of strap 6 covered correspond to the length of strap 6 forming belt 2 and designed to come into contact with the pelvis, i.e. excluding the part of first strap 6 which is situated on the other side of adjustment device 5A.

In particularly advantageous manner, at least 75% of the length of first strap 6 is covered by foam pads when belt 2 defines a minimum circumference. Preferentially, at least 75% of the length of first strap 6 is covered by foam pads when belt 2 defines a maximum circumference.

The belt is advantageously designed to adjust to a pelvis having a circumference comprised between 60 cm and 100 cm, but it is also possible to have a belt able to accommodate a circumference of more than 100 cm.

For example, in the case of a person of slight build, belt 2 defines a small circumference. It is then advantageous to increase the overlap ratio of first foam pad 7 by second foam pad 8. The excess material provided by first foam pad 7 is then located on second foam pad 8 without inconveniencing the user when performing adjustment of the circumference of belt 2 and without creating a bulge of material forming a discomfort point. The fact that first foam pad 7 is overlapped by second foam pad 8 means that two thicknesses of foam padding will be located between the user and first strap 6. For example, the overlap ratio is at least 40% when the belt defines its minimum circumference.

On the contrary, if the person is of larger build, it is necessary to have a belt with a larger circumference. It is then advantageous to stretch first foam pad 7 with respect to second foam pad 8 to increase the surface of first strap 6 which is covered by the foam pads. First strap 6 is thus always mainly covered by a comfort foam pad whatever the circumference used.

Figure 2:
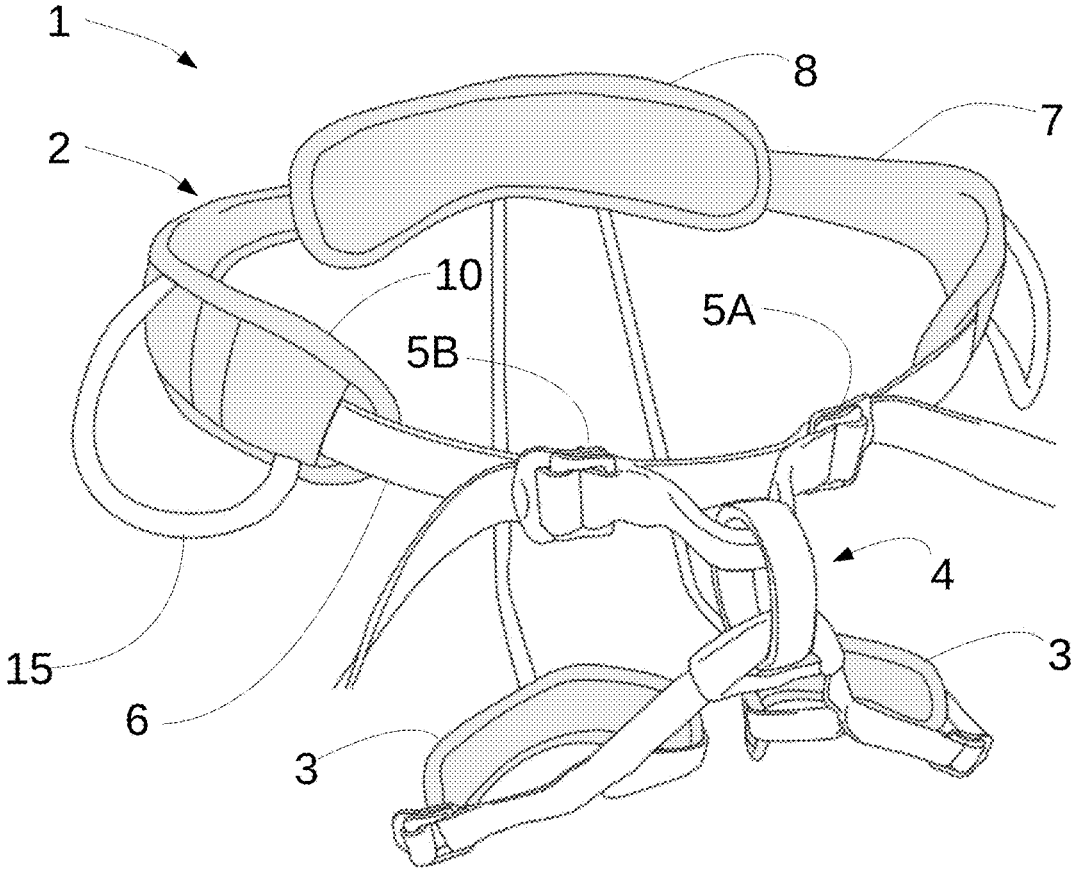

FIG. 1 illustrates an embodiment where belt 2 defines a small circumference. The overlap ratio of first foam pad 7 by second foam pad 8 is high. FIG. 2 illustrates an embodiment where belt 2 defines a large circumference. The overlap ratio of first foam pad 7 by second foam pad 8 is then much lower to maintain user comfort while reducing the ratio of direct contact between the belt and user.

It is particularly advantageous to provide for belt 2 to comprise at least a first blocking stop 9 which is configured to prevent movement of first foam pad 7 with respect to second foam pad 8 beyond a threshold value. In other words, blocking stop 9 is configured so that first foam pad 7 always overlaps second foam pad 8 whatever the circumference defined by belt 2. In the embodiment illustrated in FIGS. 7 and 8, blocking stop 9 is configured so that the minimum overlap surface is equal to at least 1% of the maximum overlap surface.

The inventors in fact observed that the use of a non-zero minimum overlap between foam pads 7 and 8 facilitates sliding of first foam pad 7 with respect to second foam pad 8 when adjusting from a large circumference to a small circumference. Adjustment is then facilitated and the user does not have to bother about the placement of foam pads 7 and 8 with respect to one another.

In a particular embodiment, first foam pad 7 is secured to second foam pad 8 by means of a mechanical connector the movement of which is prevented when the overlap ratio of the first foam by the second foam reaches a minimum threshold value. For example, the connector is a strap or a cord one end of which is fixed to first foam pad 7 or to second foam pad 8. The other end collaborates with a clamp respectively fixed to second foam pad 8 or to first foam pad 7 to stop movement of the two foam pads so that the overlap ratio is lower than the minimum threshold value. It is possible to provide for the strap/cord to be fixed at both ends, on the one hand to first foam pad 7 and on the other hand to second foam pad 8, but this leads to formation of bulges and folds when the circumference of the belt is reduced. This embodiment is more complicated to manage as it means that movement of the strap must not be impeded when it folds back.

The inventors observed that sliding of the strap in the clamp until it reaches an end-of-travel stop is easier to achieve and to use. The inventors also observed that it is particularly advantageous to fit the strap and clamp in a sheath in order to protect them and to be able to direct movement of the strap more easily when the circumference of the belt is reduced.

In an embodiment that is not illustrated, first foam pad 7 and second foam pad 8 are both fitted movable with respect to first strap 6. In this configuration, the two foam pads move with respect to one another so as to cover first strap 6 thereby adjusting to the circumference of belt 2. In advantageous manner, covering of first foam pad 7 by second foam pad 8 is at its maximum when belt 2 defines its minimum circumference. It is also advantageous to provide for covering of first foam pad 7 by second foam pad 8 to be at its minimum when the belt reaches its maximum circumference or when belt 2 defines a threshold circumference smaller than the maximum circumference. Beyond the threshold circumference, areas of belt 2 exist that are defined only by first strap 6 which can come into contact with the user. It is advantageous to provide for the areas devoid of covering by first foam pad 7 to be located on the user's abdomen and in contact with adjustment device 5A. The overlap between foam pads 7 and 8 is at its minimum when the foam pads provide maximum covering of first strap 6.

In an embodiment that is not illustrated, first foam pad 7 and second foam pad 8 are both fixed to the at least first adjustment means 5A preferably by means of a flexible part in order to place the ends of first and second foam pads 7 and 8 in immediate proximity to the belt circumference adjustment means according to the circumference of the belt. The flexible part can be loose below a threshold circumference and the tension in the flexible part increases progressively as the circumference increases. The length of the flexible part can be adjusted so that a gear sling 15 fitted on first foam pad 7 and/or on second foam pad 8 is located in the right place on the user's pelvis.

In the embodiment illustrated in FIGS. 1 to 7, belt 2 has at least a first foam pad 7, a second foam pad 8 and a third foam pad 10.

In this configuration, it is particularly advantageous to provide for second foam pad 8 to be mounted fixed on first strap 6 by means of a fixing part 11 which is for example a seam joining first strap 6 to second foam pad 8. It is also advantageous to provide for first foam pad 7 and third foam pad 10 to both be fitted movable along first strap 6.

It is also advantageous to provide for third foam pad 10 to be separated from first foam pad 7 by fixing part 11 along the longitudinal axis of first strap 6. Fixing part 11 advantageously acts as blocking stop for first foam pad 7 and third foam pad 10 in order to define a maximum movement along first strap 6.

The fixing part can also define a maximum overlap ratio for each of first and third foam pads 7 and 10 with respect to second foam pad 8 when belt 2 defines a minimum circumference. As an alternative, the blocking stops of first foam pad 7 and third foam pad 10 can be formed by other parts than fixing part 11.

Figure 7:
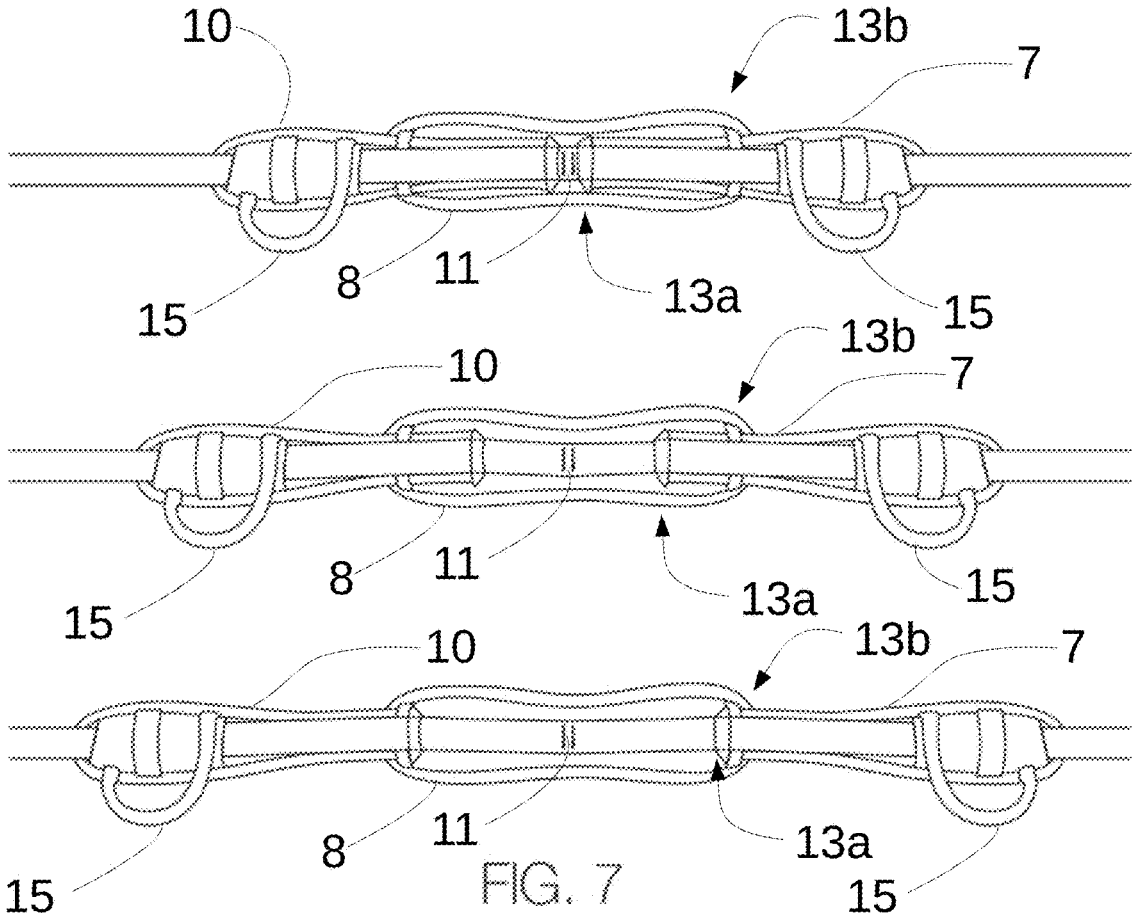
FIG. 7 illustrates three different elongations of the comfort pads which are formed by three parts which are movable with respect to one another.

Fixing part 11 is for example illustrated in FIG. 7 in the form of two seams which are configured to secure second foam pad 8 to first strap 6.

In a particularly advantageous embodiment, belt 2 comprises a second blocking stop which is configured to prevent movement of third foam pad 10 with respect to second foam pad 8 beyond a threshold value. The second blocking stop can define the minimum overlap value between second foam pad 8 and third foam pad 10.

The second blocking stop is advantageously configured so that third foam pad 10 always overlaps on second foam pad 8 whatever the circumference defined by belt 2. In other words, there is always an overlap of third foam pad 10 by second foam pad 8. As previously, this configuration facilitates placing of third and second foam pads 8 and 10 with respect to one another when the user increases the circumference of belt 2 or on the contrary when he reduces the circumference of belt 2. The user does not have to worry about correct placing of third foam pad 10 with respect to second foam pad 8 to prevent formation of bulges which would define discomfort points.

It is particularly advantageous to provide for movement of the first foam pad with respect to the second foam pad to be independent from movement of the third foam pad with respect to the second foam pad.

In the embodiment illustrated in FIGS. 1 and 2, belt 2 comprises a first adjustment device 5A and a second adjustment device 5B. The two adjustment devices 5A and 5B are configured to allow modulation of the circumference of belt 2 by means of movement of first strap 6 inside adjustment devices 5A and 5B. In advantageous manner, the two adjustment devices are fixed to connecting element 4.

First and second adjustment devices 5A and 5B are for example formed by first and second metal loops which allow first strap 6 to run freely or on the contrary to be blocked. Each of first and second adjustment devices 5A and 5B forms a blocking stop for maximum elongation respectively of first and third foam pads 7 and 10 when belt 2 defines for example the minimum circumference. These blocking stops correspond to stops defining a minimum overlap ratio of first foam pad 7 on second foam pad 8 and of third foam pad 10 on second foam pad 8.

In the embodiments illustrated in FIGS. 1 and 2, first and third foam pads 7 and 10 come up against the stop formed by the first and second blocking devices when belt 2 defines its minimum circumference. On the other hand, in the embodiment illustrated in FIG. 2, first blocking device 9 and second blocking device are configured to prevent first foam pad 7 and third foam pad 10 from coming into contact with the two adjustment devices 5A and 5B when the latter define a belt circumference that is either maximum or greater than a threshold value.

Figure 3:
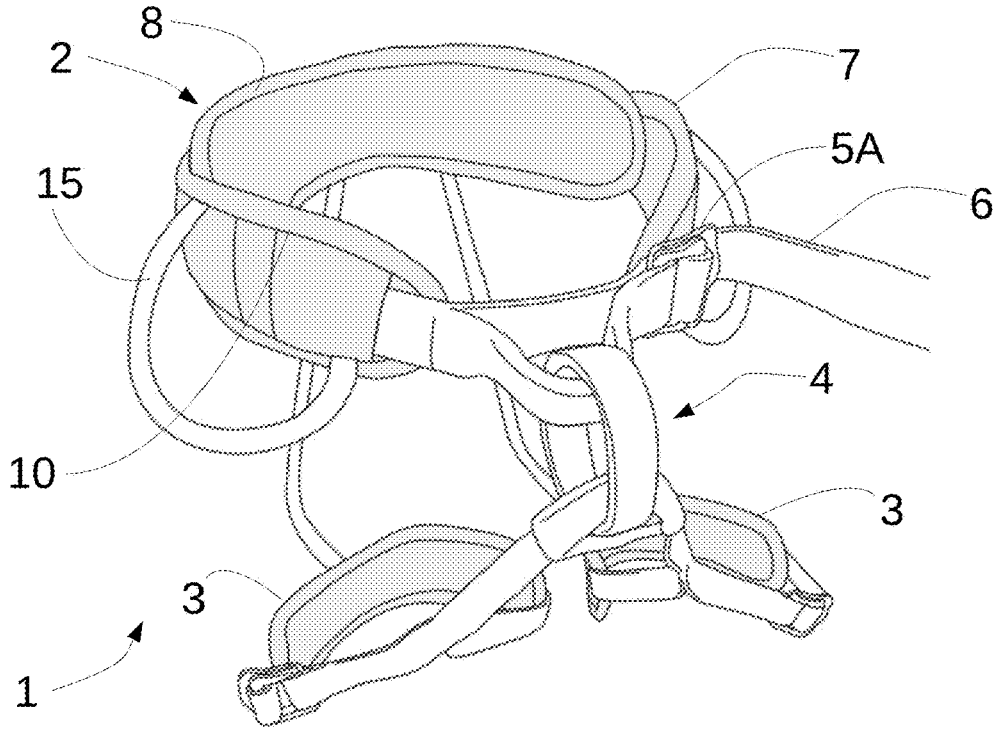
FIGS. 3 and 4 illustrate, in schematic manner, a second embodiment of a roping harness in two distinct configurations with different belt circumferences.
Figure 4:
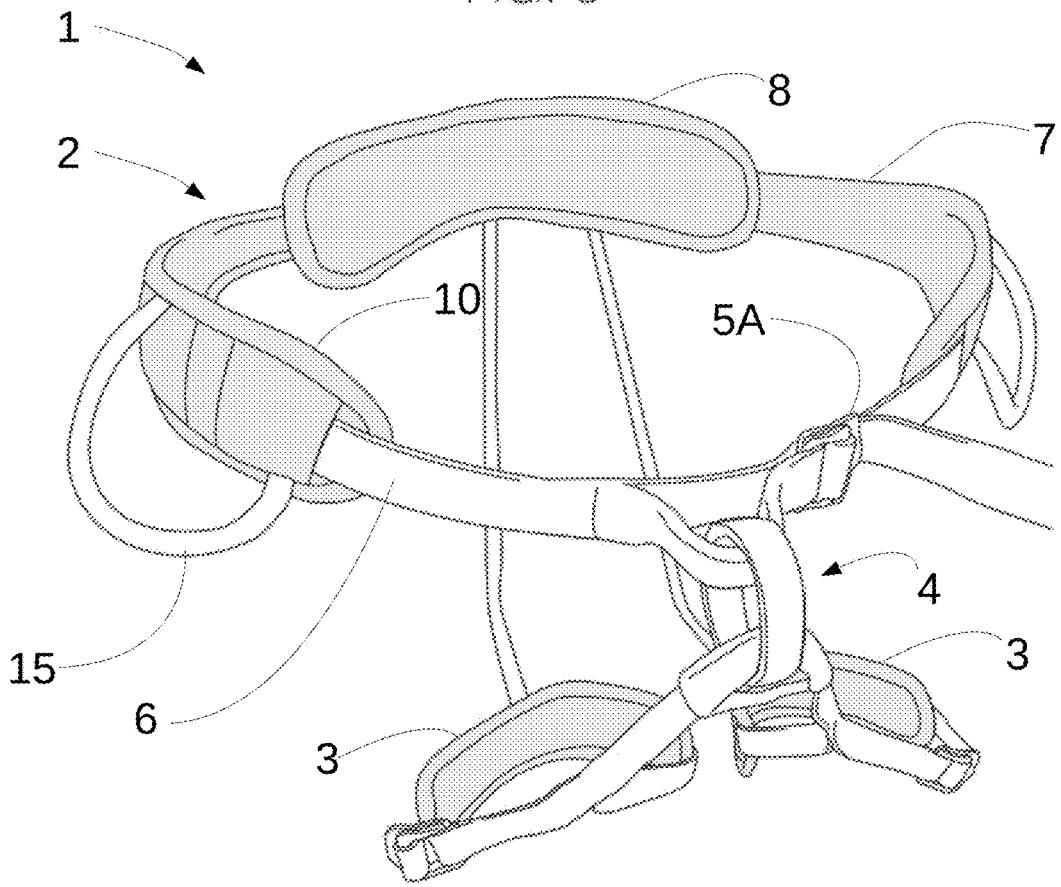

FIGS. 3 and 4 illustrate an embodiment wherein belt 2 comprises a single adjustment device 5A. In this exemplary case, by pulling on the end of first strap 6 which escapes from adjustment device 5A, the user adjusts the circumference of belt 2 to the size of his/her pelvis and he/she can subsequently adjust the position of first foam pad 7 and of third foam pad 10 to enjoy maximum comfort. The foam pad comprises a slot for securing the part of strap 6 which escapes from adjustment device 5A or any other device configured to fix the end of the first strap onto one of the foam pads.

Figure 8:
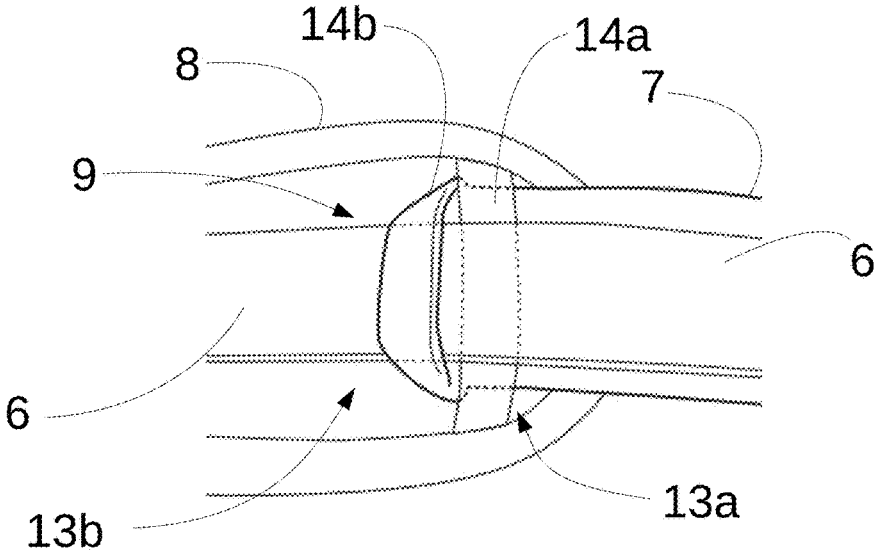
FIG. 8 represents a particular embodiment of a blocking stop between the first comfort pad and the second comfort pad.

First blocking stop 9 is advantageously achieved by means of a first slot 13 defined in first foam pad 7 or of a second slot 14 defined in second foam pad 8. Slot 13/14 is a slot enabling first strap 6 to pass through first foam pad 7 or through second foam pad 8. Slot 13/14 defined in first foam pad 7 or in second foam pad 8 is advantageously configured to operate in conjunction with a salient part located on the other foam pad 7 or 8 so as to allow sliding of first foam pad 7 with respect to second foam pad 8 up to a threshold value or until the salient part comes up against the stop formed by the slot. For example purposes as illustrated in FIG. 8, slot 13/14 can be formed by an edge 13*a*/14*a* fixed onto one surface of the foam and which defines a tunnel for passage of the other foam pad.

It is particularly advantageous to provide for each of first and second foam pads 7 and 8 to have a slot 13/14 with an edge 13*a*/14*a*. The edges are then configured to protrude from the rest of the foam pad and to come into contact with one another to form blocking stop 9 which prevents movement of first foam pad 7 with respect to second foam pad 8 beyond a threshold value. Such an embodiment is illustrated in FIG. 8. In more general manner, edges 13*a* and 14*a* are configured to collaborate with one another and to form blocking stop 9.

This configuration is particularly advantageous as it is simple to achieve and avoids additional parts having to be formed on the circumference of belt 2 as these blocking parts could form points where the harness could catch on elements of the outside environment, for example a branch.

Figure 5:
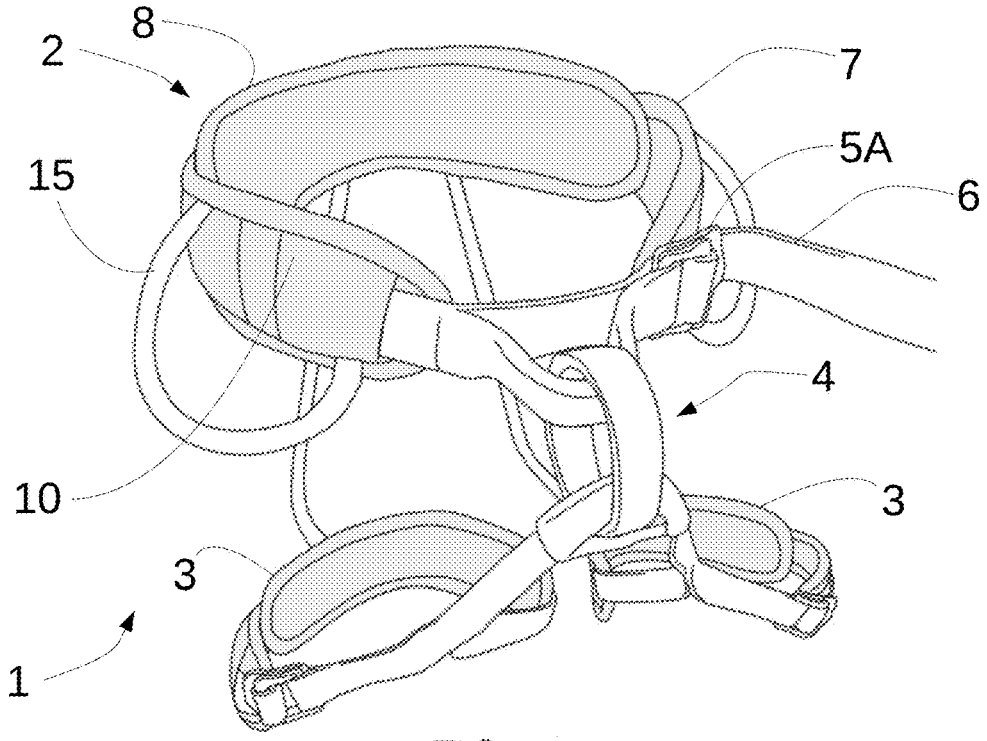
FIGS. 5 and 6 illustrate, in schematic manner, a third embodiment of a roping harness in a configuration where the thigh straps are adjustable in the same way as the belt.
Figure 6:
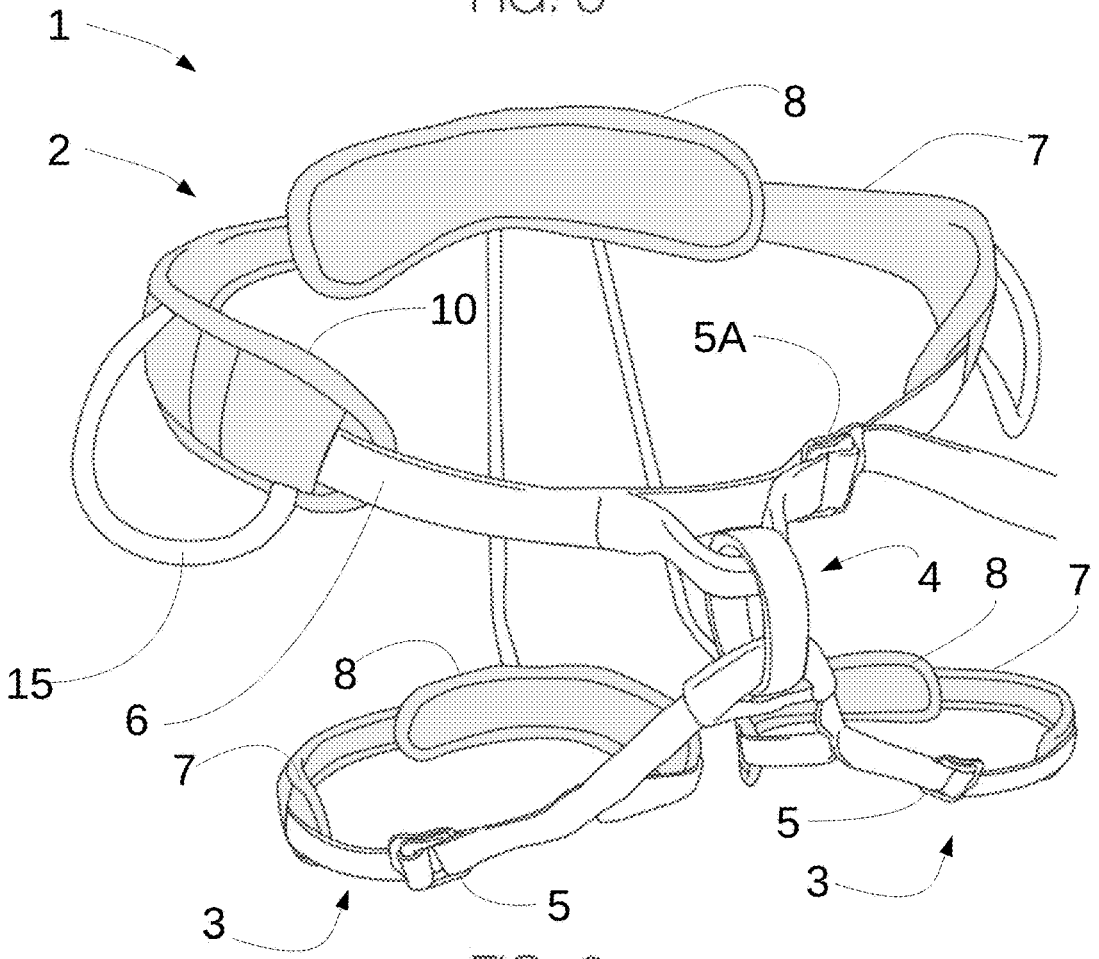

In the embodiment illustrated in FIGS. 5 and 6, the harness comprises as before a belt 2, a pair of thigh straps 3 and a connecting element 4 which closes belt 2.

In this embodiment, each thigh strap 3 is formed by at least a first foam pad 7 and a second foam pad 8. First foam pad 7 and second foam pad 8 are fitted movable in translation with respect to one another. At least first foam pad 7 is fitted movable in translation with respect to first strap 6 and first foam pad 7 moves along first strap 6.

What was explained in the foregoing for belt 2 can also be applied here for a thigh strap 3. It is therefore possible to use more than two foam pads 7 and 8. However, the circumference of a thigh being smaller than the circumference of the pelvis, it is particularly advantageous to only use a single first foam pad 7 and a single second foam pad 8.

Depending on the embodiments, first and second foam pads 7 and 8 can both be fitted movable in translation along first strap 6 or it is possible to provide for one of the foam pads to be fixed to first strap 6 by a fixing part 11.

Each thigh strap 3 comprises an adjustment device 5 which is configured to adjust the circumference of thigh strap 3. There again, the circumference of a thigh being substantially smaller than that of the pelvis, it is particularly advantageous to only use a single adjustment device 5.

As for the previous embodiments, it is advantageous to use a blocking stop 9 which is configured to prevent movement of first foam pad 7 with respect to second foam pad 8 beyond a threshold value. In preferential manner, blocking stop 9 is configured so that first foam pad 7 and second foam pad 8 always overlap on one another whatever the circumference of thigh strap 3.

This embodiment is particularly advantageous as it enables the circumference of thigh straps 3 to be adjusted to the circumferences of the user's thighs by taking advantage of first and second movable foam pads 7 and 8 which enable user comfort to be improved when the latter is seated in his harness.

As illustrated in FIGS. 1 to 6, it is particularly advantageous to fix a gear sling 15 to first foam pad 7 and possibly to third foam pad 10. First and third foam pads 7 and 10 are fitted in movable manner and are judiciously placed around the user's pelvis. Gear sling 15 which is fixed to first foam pad 7 is placed naturally by the user at the right place in order to allow easy fitting or removal of a carabiner or any other connector. This configuration cannot be obtained in the prior art where this part of belt 2 is formed only by a strap.

In the embodiment illustrated in FIG. 7, it is apparent that first foam pad 7 can move independently with respect to third foam pad 10. This configuration is particularly advantageous when the user puts his harness on, as foam pads 7 and 10 may not be correctly placed with respect to one another. For example, the arrangement of first and third foam pads 7 and 10 is not symmetrical and it is possible to have an extension of first foam pad 7 that is very different from the extension of third foam pad 10 with respect to second foam pad 8 which is a central foam pad.

In a first step represented schematically by the top drawing of FIG. 7, the user can use adjustment device 5A in order to adjust the length of strap 6 to the size of his pelvis. The three foam pads are arranged in a configuration which corresponds to a minimum or quasi-minimum belt circumference.

Once the belt has been adjusted to the circumference of the pelvis or approximately adjusted thereto, the user can move first foam pad 7 and third foam pad 10 in order to cover first strap 6 and move the gear slings nearer to more suitable locations. The intermediate drawing of FIG. 7 represents a separation distance of the three foam pads which corresponds to an average circumference. This also corresponds to an intermediate step of movement of foam pads 7 and 10 before the final adjustment movement is performed.

The bottom drawing of FIG. 7 represents a maximum separation distance of the three foam pads, i.e. a maximum distance between first foam pad 7 and third foam pad 10.

In this way, placement of the first and third foam pads with respect to the central foam pad enables a substantially symmetric arrangement of the foam pads to be achieved with respect to the sagittal plane of the user.

In the different embodiments illustrated, it is particularly advantageous to provide for second foam pad 8 which is a fixed foam pad to be located between the user and the end of first foam pad 7 and between the user and the end of third foam pad 10. In this way, when belt 2 is tightened, first foam pad 7 and third foam pad 10 can move more freely along first strap 6 without being hampered by contact with the user. However, an opposite configuration is also possible even if it is less practical in use. It is also possible to provide for first foam pad 7 and third foam pad 10 to be separated by second foam pad 8 in a direction which corresponds substantially to the thickness of second foam pad 8.

In the different illustrated embodiments, it is particularly advantageous to provide for first foam pad 7 and third foam pad 10 to each comprise a plurality of slots for passage of first strap 6. This configuration enables the friction existing between first foam pad 7 and strap 6 or between third foam pad 10 and strap 6 to be reduced while at the same time ensuring optimum positioning of first foam pad 7 and third foam pad 10 with respect to the longitudinal axis of strap 6.

It is particularly advantageous to provide for the outer surface of second foam pad 8 which is covered by first strap 6 to be free so as to facilitate sliding of first foam pad 7 with respect to second foam pad 8. This also enables an outside person to check that first and second foam pads 7 and 8 are properly fitted with respect to one another. This configuration is particularly advantageous when the harness comprises a first foam pad 7, a second foam pad 8 and a third foam pad 10.

The embodiment according to FIGS. 1 and 2 is more advantageous than the embodiment according to FIGS. 3 and 4 as adjustment of the circumference is performed by means of two adjustment devices which enables the length of the strap to be adjusted by means of both its ends. The excess length of the strap is divided by two.

This configuration enables a better adjustment of belt 2 by facilitating placement of second foam pad 8 against the user's back with an independent adjustment of first and third foam pads 7 and 10.

It is particularly advantageous to use a first foam pad which is identical to the third foam pad as far as its shape is concerned but which is oriented differently in order to define a foam pad located on the user's right side and a foam pad located on the user's left side. The two foam pads can have the user's sagittal plane as plane of symmetry.

In an advantageous embodiment comprising first foam pad 7, second foam pad 8 and third foam pad 10, it is advantageous to place a plurality of reference marks on the first and third foam pads. Advantageously the reference marks are identical on the first and third foam pads and are located in such a way as to facilitate placement of the first and third foam pads symmetrically with respect to the user's sagittal plane.

As an alternative, the reference marks can be formed on the first strap. It is also possible to combine this embodiment with the previous embodiment.

In the different exemplary embodiments set out in the foregoing, the harness comprises a plurality of foam pads that are movable with respect to one another. The foam pads represent comfort parts which are configured to distribute the stress imposed by the strap of the belt or of the thigh strap on the user's skin. The foam pad is therefore a pressure distributor and the foam pad can be replaced by or associated with a large number of different materials. It is possible to use gels, textiles and advantageously three-dimensional textiles. It is also possible to use reinforcement parts made from plastic or from other materials which are able to deform to better distribute the stress of the strap. The comfort parts advantageously enable the contact surface with the user to be increased, as they present a larger width than that of the strap. The comfort parts can deform to adjust to the user's build.

The invention claimed is:

1. A roping harness comprising:

a belt provided with a first strap and with first and second comfort pads configured to be arranged between the first strap and a user;

a pair of thigh straps mechanically connected to the belt;

at least a first adjustment device configured to adjust a length of the first strap and to adjust a circumference of the belt;

wherein:

the first comfort pad and the second comfort pad are fitted movably in translation with respect to the first strap along the first strap, with respect to the at least a first adjustment device and with respect to one another;

the first comfort pad always overlaps the second comfort pad;

the first comfort pad and the second comfort pad are fitted to slide with respect to one another so that an overlap ratio of the first comfort pad by the second comfort pad is modified according to relative positions of the first comfort pad with respect to the second comfort pad; and the belt comprises at least a first blocking stop configured to prevent movement of the first comfort pad with respect to the second comfort pad beyond a threshold value representing a minimum overlap ratio.

2. The roping harness according to claim 1, wherein the first comfort pad and the second comfort pad cover at least 75% of the length of the first strap.

3. The roping harness according to claim 1, wherein the first comfort pad and the second comfort pad cover at least 75% of the length of the first strap when the circumference of belt is minimal and cover at least 75% of the length of the first strap when the circumference of belt is maximal.

4. The roping harness according to claim 1, wherein the overlap ratio is at least 40% when the circumference of the belt is minimal.

5. The roping harness according to claim 1, comprising a second adjustment device configured to adjust the circumference of the belt, the second adjustment device forming an additional blocking stop configured to prevent movement of the second comfort pad with respect to the first comfort pad beyond an additional threshold value.

6. The roping harness according to claim 1, wherein the first adjustment device is fixed to a connecting element mechanically connecting the belt to the pair of thigh straps.

7. The roping harness according to claim 1, wherein the first comfort pad comprises a first slot for passage of the first strap, the first slot being defined by means of a first edge and the second comfort pad comprises a second slot for passage of the first strap, the second slot defined by means of a second edge, the first slot and second slot being configured to form the first blocking stop preventing the first edge from passing through the second slot or the second edge from passing through the first slot.

8. A roping harness comprising:

a belt;

a pair of thigh straps, each thigh strap being provided with a first strap and with at least first and second comfort pads configured to be arranged between the first strap and a user, the pair of thigh straps being mechanically connected to the belt;

a first adjustment device configured to adjust the length of the first strap and to adjust a circumference of the thigh strap;

wherein the first comfort pad always overlaps the second comfort pad;

the first comfort pad and second comfort pad are fitted to slide with respect to one another so that an overlap ratio of the first comfort pad by the second comfort pad is modified according to relative positions of the first comfort pad foam with respect to the second comfort pad;

the first comfort pad is fitted movably in translation with respect to the first strap along the first strap and to the first adjustment device; and each thigh strap comprises at least a first blocking stop configured to prevent movement of the first comfort pad with respect to the second comfort pad beyond a threshold value, the first adjustment device forming a second blocking stop of the first comfort pad.

9. The roping harness according to claim 8, wherein the second comfort pad is fixed to the first strap by a fixing part.

10. A roping harness comprising:

a belt provided with a first strap and with first, second and third comfort pads configured to be arranged between the first strap and a user;

a pair of thigh straps mechanically connected to the belt;

at least a first adjustment device configured to adjust a length of the first strap and to adjust a circumference of the belt;

wherein:

the second comfort pad separates the first comfort pad and the third comfort pad, the first comfort pad and the third comfort pad are fitted movably with respect to the second comfort pad and are fitted movably in translation with respect to the first strap along the first strap, the first comfort pad and the second comfort pad are fitted to slide with respect to one another, the first comfort pad always overlaps the second comfort pad, and the belt comprises at least a first blocking stop configured to prevent movement of the first comfort pad with respect to the second comfort pad beyond a threshold value representing a minimum overlap ratio between the first comfort pad and the second comfort pad.

11. The roping harness according to claim 10, wherein the second comfort pad is fixed to the first strap by a fixing part, the third comfort pad being separated from the first comfort pad by the fixing part and wherein the third comfort pad always partially covers the second comfort pad.

12. The roping harness according to claim 11, comprising a second blocking stop configured to prevent movement of the third comfort pad with respect to the second comfort pad beyond a threshold value.

13. A roping harness according to claim 10, wherein the second comfort pad is mounted fixed on the first strap by means of a fixing part and the fixing part form a blocking stop defining a maximum overlap ratio for each of the first and third comfort pads with respect to second foam pad when the circumference of the belt is minimal.

14. A roping harness according to claim 10, comprising the first adjustment device and a second adjustment device configured to adjust the length of the first strap and to adjust the circumference of the belt, the first and second adjustment devices forming a blocking stop defining a maximum elongation of the first and third comfort pads when the circumference of the belt is minimal.

* * * * *